US008387815B2

(12) United States Patent
Breslend

(10) Patent No.: US 8,387,815 B2
(45) Date of Patent: Mar. 5, 2013

(54) APPARATUS AND METHOD FOR SEQUENTIAL BAGGING OF MATERIALS

(76) Inventor: Patrick Ryan Breslend, Jacksonville, FL (US)

( * ) Notice: Subject to any disclaimer, the term of this patent is extended or adjusted under 35 U.S.C. 154(b) by 234 days.

(21) Appl. No.: 12/657,900

(22) Filed: Jan. 29, 2010

(65) Prior Publication Data

US 2011/0185684 A1 Aug. 4, 2011

(51) Int. Cl.
*B65D 90/00* (2006.01)

(52) U.S. Cl. ..... 220/495.07; 220/495.01; 220/495.06; 220/908; 220/908.1; 206/459.5; 206/831

(58) Field of Classification Search ..... 220/495.01, 220/495.06, 495.07, 908, 908.1; 206/459.5, 206/831

See application file for complete search history.

(56) References Cited

U.S. PATENT DOCUMENTS 4,909,636 A * 3/1990 De Matteis et al. ..... 383/8
2006/0056741 A1* 3/2006 Yang et al. ..... 383/33
2007/0235455 A1* 10/2007 Goldberg ..... 220/495.07

* cited by examiner

*Primary Examiner* — Anthony Stashick
*Assistant Examiner* — Elizabeth Volz
(74) *Attorney, Agent, or Firm* — Robert C. Brown

(57) ABSTRACT

A system comprising a multiple-bag pack supported for dispensing, loading, and removal of bags on a structure. The pack includes a bag-attachment portion wherein the multiple bags are sequentially attached. Each bag is removable in sequence by separation from the pack along a parting feature. The bags are contained within the structure and the bag-attachment portion is folded outwards over a lip to secure the bag pack. The front edge of the outermost bag of the pack is drawn over another lip to open the bag for loading. The rear edge remains attached to the bag pack, thus fully distending the mouth of the bag. To change bags, the rear edge of the bag is separated from the pack and the first lip along the parting structure. The front edge of the loaded bag is removed from the second lip, and the bag is closed and removed from the structure.

15 Claims, 4 Drawing Sheets

APPARATUS AND METHOD FOR SEQUENTIAL BAGGING OF MATERIALS

TECHNICAL FIELD

The present invention relates to the practice of bagging materials for subsequent transport; more particularly, to bagging practice wherein a plurality of bags are used sequentially over time; and most particularly, to a system (apparatus and method) for sequential bagging of materials wherein a plurality of bags to be used are stored in and dispensed from a bag-loading device comprising a frame structure that both supports each bag over opposing edges of the structure and distends the mouth of each bag for loading.

BACKGROUND OF THE INVENTION

It is well known to accumulate and transport materials in single-use flexible bags. This practice is used in activities ranging at least from residential and restaurant waste disposal, to industrial collection and shipping of in-transit letters and packages by delivery companies, to bagging of purchased items in department stores and supermarkets.

In some prior art applications, such as in bagging fruits and vegetables by customers in a supermarket, sequential bags are dispensed from a dispenser by sequential customers and are loaded by the customers, without benefit of a supportive frame. Bags are provided to the supermarket in the form of bag packs comprising a plurality of identical bags wherein only the outermost bag is available for use, removal of which presents the next bag for use. Typically, the bags in a pack are attached in some fashion near the tops of the bags to ensure integrity of the pack prior to use.

In some other prior art applications, bags are dispensed as just described, but each bag is then supported by an enabling structure, which may be open or closed on the sides but open at the top, and which serves to keep the mouth of the bag open for a user during loading. A trash can, garbage can, or waste basket is a typical enabling structure of this type. The enabling structure may be rectangular or round. In many such applications, such as in waste receptacles for fast food restaurants and home kitchens, the bag pack is typically a roll or package of sequentially-arranged bags stored remotely from, or in the bottom of, the receptacle. After a bag is filled by customers' discarded waste, a worker removes the filled bag from the receptacle by lifting the bag vertically out of the structure and then replacing the filled bag with a fresh bag, typically obtained from a remote storage, stretched over the four lips of the receptacle structure.

A shortcoming of a structure closed on the sides is that the new bag can undesirably trap air between the bag and the wall of the structure, thus inhibiting proper expansion of the bag in use. In other instances wherein the structure is an open-sided frame, the bag is free to expand.

Obtaining each bag from a remote source as needed and installing the bag into the receptacle is time-consuming for a worker and thus is cost-inefficient. Further, such applications wherein each full bag must be lifted out of the structure are physically demanding of workers and can give rise to back injuries in the work force.

In still other prior art applications, a pack of bags is dispensed sequentially from a dispensing frame which then serves further to support each bag during loading. This arrangement is an efficiency improvement in that a worker is not required to obtain each bag as needed from a remote location. However, each dispensed bag is supported only loosely on the left and right edges by frame rails extending through openings along the edges of the bag mouth, and thus the mouth of the bag is not held fully open by the device, making it somewhat difficult for a worker to load successive items into the bag. Further, the bag is not prevented by the frame from being separated prematurely and undesirably from the pack.

US Patent Application Publication No. US 2007/0235455 discloses a garbage can liner system wherein multiple plastic bags are compressed into a flat pack having a supportive edge, which may include a frame, surrounding the pack. Each of the bags is joined to its adjacent bag along a tearable line. The supportive edge rests on the entire surrounding lip of a standard size garbage pail, with all the bags in the pack being pushed down and distended to fit into the pail, such that all bags are placed in an opened state. As each successive top plastic bag is filled with trash, it is torn away from the surrounding supportive edge and removed from the pail through the top opening of the pail, leaving the next bag neatly in place for filling.

What is needed in the art is a system (apparatus and method) for storing, dispensing, and loading successive bags wherein bags are provided in a multiple-bag pack supported by a structure, wherein upon being dispensed each bag is supported by the structure for loading, wherein the mouth of each bag is fully distended in the structure by having the front and rear edges of the bag folded over the top of the structure, and wherein each bag is prevented during loading from being separated prematurely from the bag pack.

It is well known in the prior art to insert a new bag into a structure that is open at the top and then to secure the bag in place by folding the open edges of the bag over the top edge of the structure. What is not disclosed in the prior art is how to combined this mounting method with a multiple-bag pack that relieves the user from obtaining and installing a new bag from a remote location each time the bag must be changed. It is a principal object of the present invention to facilitate the sequential loading of bags.

It is a further object of the invention to reduce worker fatigue and to increase worker efficiency in installing, loading, and removing sequential bags from a supportive structure.

SUMMARY OF THE INVENTION

Briefly described, a system in accordance with the present invention comprises a multiple-bag pack supported for dispensing, loading, and removal on a structure that may be polygonal or round, such as rectangular or circular. Preferably but not necessarily, the structure is open on, or in the case of a circular structure has an opening in, at least one side. Each loaded bag may be removed from the structure preferably by sliding the bag laterally from the structure through the open side. The pack includes a bag-attachment portion wherein the multiple bags are sequentially attached in a fashion similar to the pages in a paper writing tablet. Each bag is removable in sequence by separation from the pack along a parting feature, for example, a line of perforations, defining a separation line of the bags from the bag-attachment portion.

The bag portions of the bag pack are contained within the structure which has a plurality of lips in the case of a rectangular structure, or a single circular lip in the case of a cylindrical structure. The bag-attachment portion is folded outwards over only a portion of a lip to capture and secure the bag pack in the structure. This arrangement also captures the rear edge of the bag currently in use outside of and below the lip, thereby preventing premature separation from the pack and permitting full distension of the bag mouth during loading.

The front edge of the outermost bag of the pack is separated from the bag-attachment portion and is drawn over another lip, preferably an opposing lip, or over the remainder of the circular lip in the case of a cylindrical structure, to open the bag for loading. The rear edge remains attached to the bag pack, thus fully distending the mouth of the bag.

To change bags, the rear edge of the bag is separated from the pack along the parting feature, which also presents the front edge of the next bag in the pack. The front edge of the loaded bag is removed from the second lip, and the bag is closed and removed from the structure. The cycle is repeated until the bag pack is exhausted.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiments of the invention, and such exemplifications are not to be construed as limiting the scope of the invention in any manner.

DESCRIPTION OF THE PREFERRED EMBODIMENTS

Figure 1:
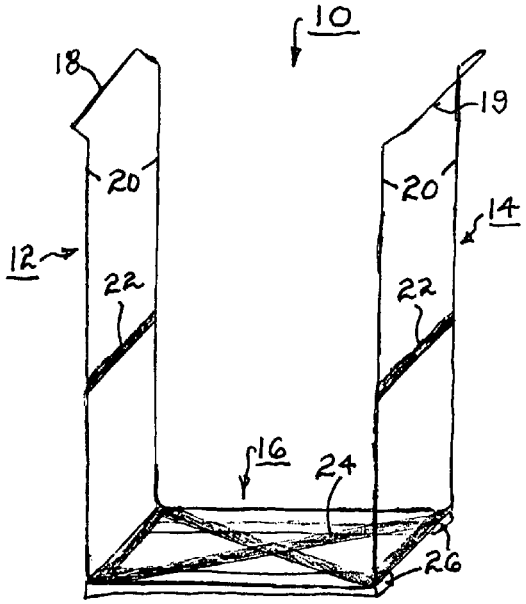
FIG. 1 (PRIOR ART)
FIG. 1 is an isometric view of a first exemplary structure formed of metal rod material in accordance with the prior art.
Figure 2:
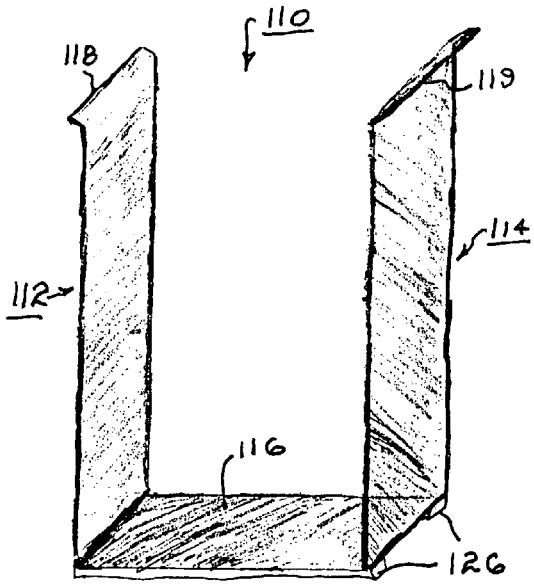
FIG. 2 is an isometric view of a second exemplary structure formed of molded plastic in accordance with the present invention.
Figure 3:
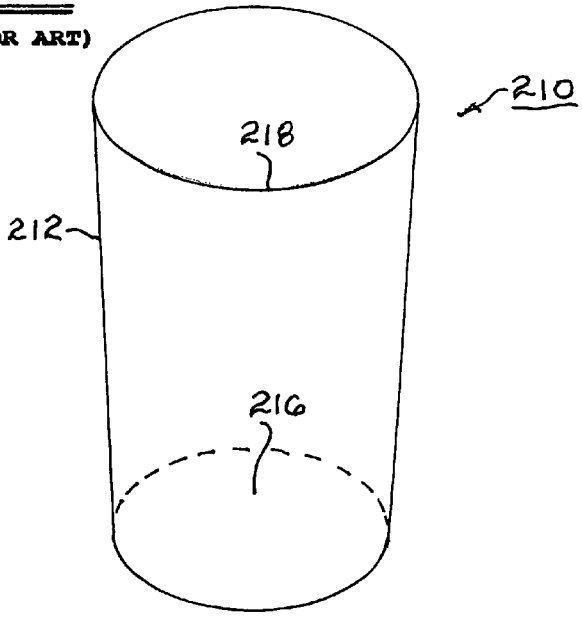
FIG. 3 (PRIOR ART)
FIG. 3 is an isometric view of a third exemplary structure formed as a cone or cylinder in accordance with the prior art.

Referring to FIGS. 1 through 3, structures 10,110,210 are shown that may be incorporated into a system in accordance with the present invention, as described hereinbelow.

Figure 12:
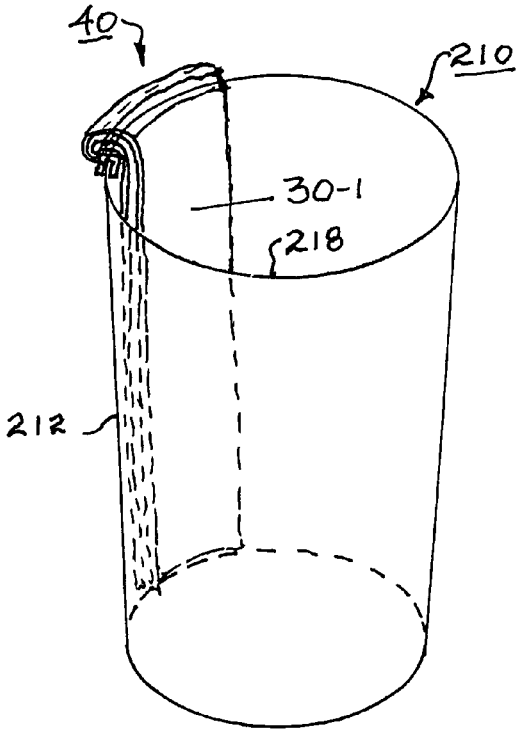
FIG. 12 is an isometric view of a system in accordance with the present invention, showing the pack of bags shown in FIG. 5 disposed for use in the prior art round structure shown in FIG. 3.

Referring to FIG. 1, prior art structure 10 is a framework formed typically of bent and welded metal rod, comprising first and second open upright sides 12,14 connected by a bottom 16, and terminating at first and second lips 18,19 which preferably but not necessarily are flared outward. First and second lips 18,19 define the entire lip of structure 10. The upright elements 20 of sides 12,14 may be connected by one or more horizontal straps 22, and bottom 16 may be reinforced by X-shaped or other reinforcing 24. Bottom 16 may be supported by one or more skids 26 and/or casters (not shown) to facilitate moving structure 10. Typically, virtual third and fourth sides extending between sides 12,14 are omitted to permit removal of a bag of materials from structure 10 laterally through either virtual side, although either or both of those sides may be provided as may be desired, in accordance with the present invention. Alternatively, and less desirably, a loaded bag may be removed from a structure 10 having no open side, as in the prior art (see, for example, FIGS. 3 and 12). Typically, sides 12,14 as they extend upward from bottom 16 define springs that may be resiliently flexed toward and away from each other, to the benefit of a system in accordance with the present invention as described hereinbelow.

More generally, structure 10 is polygonal and includes a plurality of lips surmounting a plurality of adjoining sides.

Referring to FIG. 2, novel structure 110 is formed in accordance with the present invention to mimic prior art structure 10. Structure 110 is formed by heating and folding of a thermoplastic sheet of stock to yield first and second sides 112,114 having first and second lips 118,119 and bottom 116. As in structure 10, skids 126 and/or casters (not shown) may be provided. Because the starting material is a continuous thermoplastic sheet, sides 112,114 and bottom 116 are solid rather than being open framework as in prior art structure 10. Sides 112,114 also are resiliently flexible toward and away from each other as described for prior art structure 10. Also, the virtual open sides of structure 110 may be closed as by attachment of appropriately formed side pieces as may be desired, in accordance with the present invention.

Referring to FIG. 3, prior art structure 210 may be formed as a generally round structure, such as a cylinder or low-taper truncated (frusto-conical) cone, having a single continuous side 212 and bottom 216 and terminating in a single continuous lip 218 at the open top. Examples are known trash receptacles, formed of metal and/or plastic.

Figure 4:
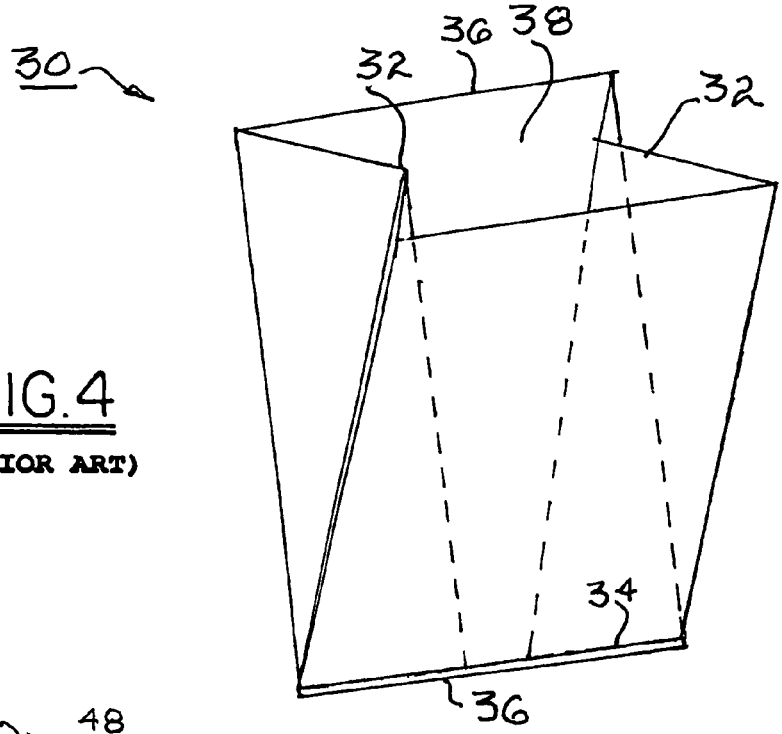
FIG. 4 (PRIOR ART)
FIG. 4 is an isometric view of an exemplary pleated bag partially unfolded, as is known in the prior art.

Referring to FIG. 4, it is well known in the art of packaging to form a bag 30 of a continuous flexible material such as plastic sheeting, fabric, or the like. The selected material may be recyclable or may be intended for single use and disposal as by landfilling or burning.

Typically, such bags when formed of plastic sheeting are first formed into a continuous tube. The tube is then folded longitudinally into opposing pleats 32 to create a flattened tube that is thermally welded at a transverse weld line 34 and perforated transversely at a parting feature 36 at intervals, defining individual bag units serially disposed between the parting features. The tube is then rolled up for later consumption by a user. In use, the outer bag is unrolled and separated at the parting feature. The non-welded end of the bag is opened for use, and the pleats are opened at the non-welded end defining a bag mouth 38. The pleats at the welded end remain closed by the weld 34.

In addition to rolling bags 30, it is known in the art to form a pack of bags by forming a plurality of individual bags 30, arranging them in parallel much like a deck of playing cards, and then removably attaching them together, typically adjacent to open ends 38, such that sequential bags may be dealt like playing cards from the pack by separating each successive bag in sequence via a parting feature formed in each bag adjacent the intended open end. The plurality of bags are mutually joined in a bag-attachment portion of a pack by a method selected from the group consisting of, for example, thermal welding, ultrasonic welding, and stitching.

This arrangement is well known for bagging produce, clothing, and other purchases at the check-out stations in various types of markets. Typically, the pack of bags is disposed either in a clamping structure or on rails via a plurality of openings formed in the pack of bags. The bags may be separated by detaching the front edge of a bag along the bag parting feature while the rear edge remains temporarily attached to the pack along its parting feature. The bag is loaded by a user, then the rear edge is detached.

A shortcoming of such a prior art system, as noted above, is that each dispensed bag is supported only loosely on the left and right edges by frame rails extending through the openings along the edges of the bag mouth, and thus the mouth of the bag is not held fully open, making it somewhat difficult for a worker to load successive items into the bag. Further, the bag is not prevented by the frame structure from being separated prematurely and undesirably from the pack along the rear edge of the bag.

Figure 5:
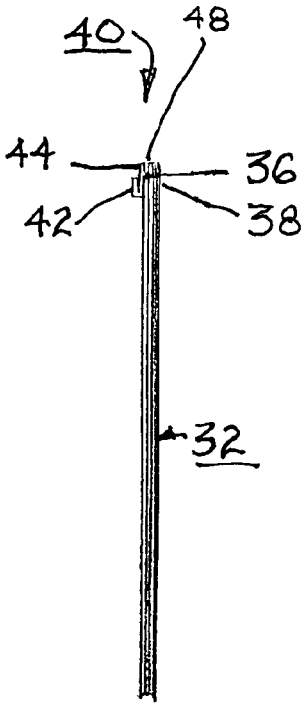
FIG. 5 is a side elevational view of a pack of bags in accordance with the present invention.
Figure 6:
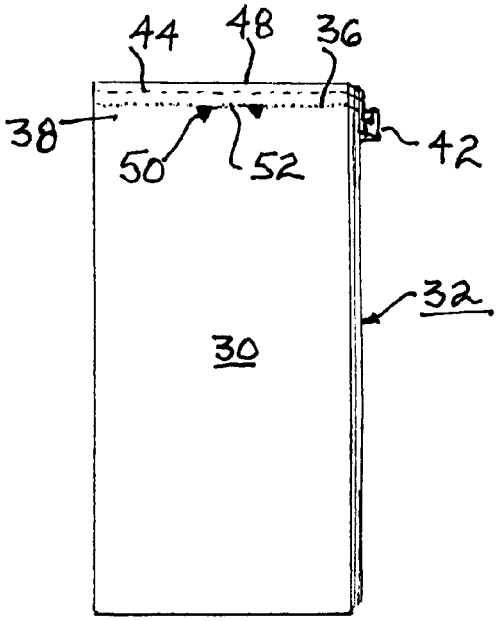
FIG. 6 is a front elevational view of the pack of bags shown in FIG. 5.
Figure 7:
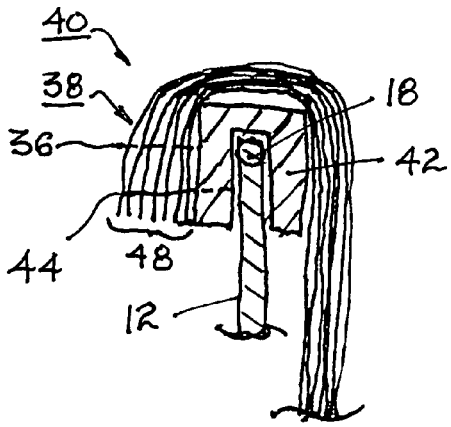
FIG. 7 is a detailed view of the area shown in Circle 7 in FIG. 9, after the pack of bags is mounted on a structure by a method in accordance with the present invention.

Referring now to FIGS. 5 through 7, a first embodiment 40 is shown of an improved pack of bags in accordance with the present invention for being supported for sequential dispensing, loading, and removal on a structure side 12 and lip 18. A plurality 32 of bags 30, each of which as may be formed in accordance with the prior art, are laid up in a pack 40 and attached to a bag-attachment header 42 as by stitching, welding, or the like along a transverse attachment line 44 near the intended open ends 38 of the bags, whereby all of the bags are rendered closed and are not accessible for loading. Further, each bag is provided with a transverse parting feature 36 located such that attachment line 44 is between the parting features 36 and the end 48 of pack 40. Preferably, parting feature 36 includes at least one cut-out 50 to form a free tab 52 for a user to grasp in dispensing the outermost bag from the pack.

Figure 8:
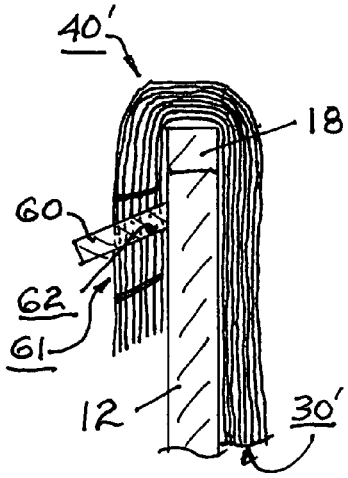
FIG. 8 is a detailed view of an alternative embodiment of the portion of the pack of bags shown in FIG. 7, also mounted on a structure.
Figure 9:
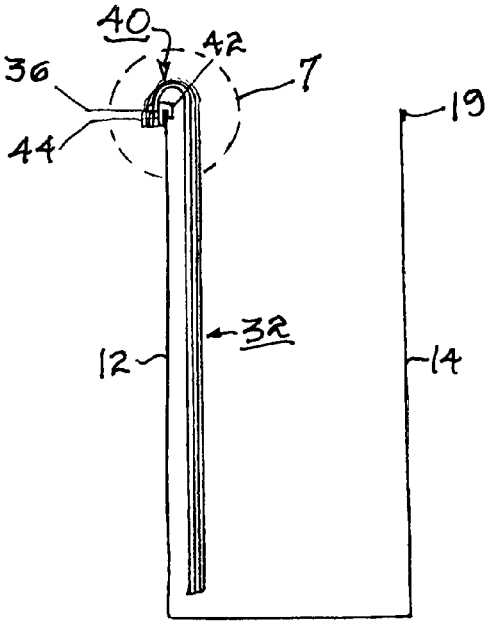
FIG. 9 is a cross-sectional view of a system in accordance with the present invention, showing the pack of bags shown in FIG. 5 mounted on the structure shown in FIG. 1.
Figure 10:
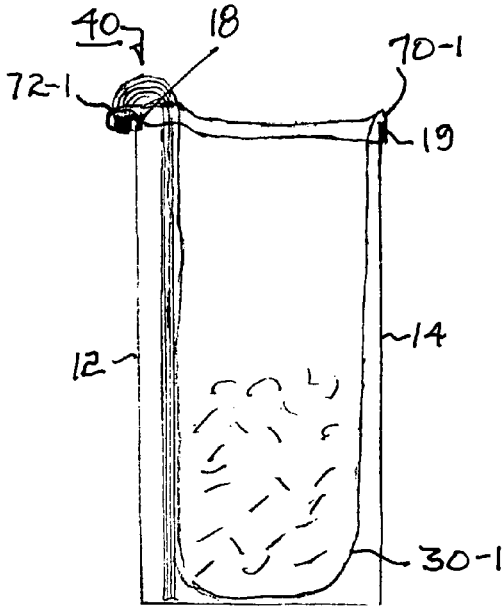
FIG. 10 is a cross-sectional view like that shown in FIG. 9, showing the first bag dispensed from the pack of bags into a ready position for loading, and being partially loaded.
Figure 11:
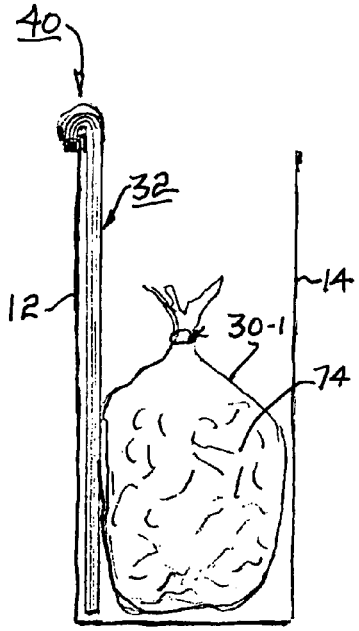
FIG. 11 is a cross-sectional view like that shown in FIGS. 9 and 10, showing a loaded bag disengaged from the bag pack and ready for removal from the structure.

It should be understood that the disclosed form of attachment is only exemplary. For example, referring to FIG. 8, side 12 of structure 10 (or 110,210) may be provided with one or more protruding hooks 60 on which the attachment portion 61 of a bag pack 40' may be secured via openings 62 in the individual bags 30'. Preferably, bag pack 40' omits bag-attachment header 42. Other forms of attachment of a bag pack to a dispensing structure as may occur to those of ordinary skill in the art are fully comprehended by the invention.

Referring to FIGS. 7 through 12, an important and novel aspect of the present invention is now apparent. The bag portions of a pack of bags 40 are contained and hang inside supportive structure 10 (or 110,210) along side 12, and bag-attachment attachment header 42 or header portion 61 is folded over first lip 18, which is only a portion of the entire lip defined by first and second lips 18,19, to capture and secure pack 40,40' in the structure FIGS. 7-9). It will be seen that such folding of the attachment header or header portion over first lip 18,118,218 serves to dispose all the parting features 36 outside the structure, which is a significant improvement over prior art bag dispensing systems wherein a parting feature is disposed within a dispensing frame. Thus, as the bags are dispensed for use, each successive outer bag 30 is supported and retained along its rear edge by first lip 18 as well as along its front edge by second lip 19, whereas in the prior art each bag is supported only along the parting feature within the frame and thus is vulnerable to being prematurely torn loose from its parent pack during loading.

In use, the front edge 70-1 of the outermost bag 30 of pack is separated from header 42 or bag-attachment portion 61 and is drawn over second lip 19,119 (or around single lip 218 of round structure 210) to open the bag for loading. The rear edge 72-1 remains attached to the bag pack. Preferably, the bags and the structure are sized such that the mouth of each bag becomes fully distended by the structure. Preferably, first and second structure sides 12/14 and lips 18/19 and 118,119 are mutually resilient as described above such that the mouth 38 of each bag is slightly stretched upon completion of installation, which acts further to anchor the bag to the structure. It is now seen that a further advantage of disposing parting feature 36 at the outside of first lip 18 and structure wall 12 is that the bag mouth 38 may be pulled taut by second lip 19 without causing the bag to separate from the pack along parting feature 36, as can occur undesirably in prior art bag-dispensing systems.

It should be noted that in systems wherein the structure comprises a lip or lips fully encircling the open end of the structure a bag is normally folded outwards over all of the lip or lips. However, an important feature of the present invention is that the bag be folded over at least the opposing portions of the lip or lips, including the lip over which the bag-attachment portion is folded.

After the first bag 30-1 is loaded with materials 74 and is ready for removal (FIG. 10), the rear edge 72-1 of the first bag 30-1 is separated from pack 40 and first structure lip 18, which action serves to present the front edge of the next bag in the pack; the front edge 70-1 of the loaded bag is removed from the second structure lip 19. First bag 30-1 then is closed as by any convenient means (FIG. 11) and is translated laterally for removal preferably via an open side of structure 10 as described above. An open side is defined as a virtual third or fourth side extending vertically between upright sides 12,14. The front edge of the second bag of pack 40 then is separated along its parting feature 36 and is drawn over second lip 19 to open the second bag for loading; the rear edge of the second bag remains drawn over the first lip.

The cycle may be repeated until the bag pack is exhausted and must be replaced.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system for sequential bagging of materials comprising:

a) a bag pack including a plurality of individual bags, wherein said bags in said pack are collapsed and stacked side by side for dispensing sequentially from one side of said pack by opening one bag at a time while all other of said bags remain collapsed, each bag having an attachment portion and a bagging portion including a parting feature therebetween, each bagging portion comprising a rear edge and an opposing front edge and first and second pleated edges therebetween, said plurality of bags being joined together at said attachment portions to define a bag-attachment portion of said bag pack; and b) a structure for receiving said bag pack and dispensing sequential bagging portions from said bag pack, wherein said plurality of bagging portions are disposed within said structure, wherein said bag-attachment portion and said parting feature and said rear edge are disposed outside said structure by being folded over only a first portion of a lip of said structure, and wherein each of said bagging portions when opened is supported on said structure by having said parting feature and said rear edge of said bagging portion still folded over said first portion of said lip and said opposing front edge of said bagging portion folded over an opposing second portion of said lip of said structure.

2. A system in accordance with claim 1 wherein said structure further comprises at least one hook extending from an outer side of said structure for securing said bag pack to said structure.

3. A system in accordance with claim 1 wherein said parting feature is a transverse line of perforations.

4. A system in accordance with claim 1 wherein said plurality of bags are mutually joined in said bag-attachment portion by a method selected from the group consisting of thermal welding, ultrasonic welding, and stitching.

5. A system in accordance with claim 1 wherein said bag pack further comprises a header for attachment of said plurality of bags thereto.

6. A system in accordance with claim 1 wherein said structure is formed of metal rod stock.

7. A system in accordance with claim 1 wherein said structure is formed of a thermoplastic material.

8. A system in accordance with claim 1 wherein said one bag is an outermost bag of said bag pack.

9. A system in accordance with claim 1 wherein the shape of said structure is polygonal and includes a plurality of lips surmounting a plurality of opposing sides.

10. A system in accordance with claim 9 wherein said structure comprises two opposing sides surmounted by two opposing lips.

11. A system in accordance with claim 1 wherein said structure is circular and includes a circular lip surmounting a circular wall.

12. A system in accordance with claim 11 wherein the shape of said circular structure is selected from the group consisting of cylindrical and frusto-conical.

13. A method for sequentially dispensing a plurality of bags, comprising the steps of:

a) providing a bag pack including a plurality of individual bags, wherein said bags in said pack are collapsed and stacked side by side for dispensing sequentially from one side of said pack by opening one bag at a time, each bag having an attachment portion and a bagging portion including a parting feature therebetween, each bagging portion comprising a rear edge and an opposing front edge and first and second pleated edges therebetween, said plurality of bags being joined together at said attachment portions to define a bag-attachment portion of said bag pack;

b) providing a structure for receiving said bag pack and dispensing sequential bags from said bag pack, wherein said structure is open at the top and has at least one wall surmounted by at least one lip;

c) mounting said bag pack onto said lip over only a first portion thereof such that said plurality of bagging portions are disposed within said structure and said bag-attachment portion including said plurality of parting features and said rear edge of said bagging portion are disposed outside said structure by being folded over said first portion of said lip of said structure, wherein each of said bagging portions when opened is supported on said structure by having said rear edge of said bagging portion still folded over said first portion of said lip and said opposing front edge of said bagging portion folded over an opposing second portion of said lip of said structure;

d) detaching a front edge of the first bag in said bag pack from said bag pack and folding said detached front edge over said opposing second portion of a lip of said structure to open said first bag for loading while all other of said bags remain collapsed;

e) detaching a rear edge of said first bag from said bag pack; and f) removing said first bag from said structure.

14. A method in accordance with claim 13, comprising the further step of repeating steps d, e, and f until said bag pack is consumed.

15. A system for sequential bagging of materials comprising:

a) a bag pack including a plurality of individual bags, wherein said bags in said pack are collapsed and stacked side by side for dispensing sequentially from one side of said pack by opening one bag at a time while all other of said bags remain collapsed, each bag having a bag-attachment portion and a bagging portion, wherein each bagging portion comprises a rear edge and a front edge; and b) a structure for receiving said bag pack and dispensing sequential bagging portions from said bag pack, said structure having opposing first and second lip portions, wherein said plurality of bagging portions are disposed within said structure and said plurality of bag-attachment portions and rear edges are disposed outside said structure by folding said bag pack over only said first portion of a lip of said structure, and wherein each of said bagging portions when opened is supported on said structure by having said rear edge of said bagging portion still folded over said first lip portion, and said front edge of said bagging portion folded over said opposing second lip portion.

* * * * *